US005235829A

United States Patent [19]

Belluzzi

[11] Patent Number: 5,235,829

[45] Date of Patent: Aug. 17, 1993

[54] ROLLER DYEING MACHINE FOR SURFACE IMPREGNATING HIDES AND SIMILAR PRODUCTS

[75] Inventor: Lino Belluzzi, Vicenza, Italy

[73] Assignee: Officine di Cartigliano S.p.A., Italy

[21] Appl. No.: 787,024

[22] Filed: Nov. 4, 1991

[30] Foreign Application Priority Data

Nov. 9, 1990 [IT] Italy ..... 85639 A/90

[51] Int. Cl.[5] ..... C14C 11/00; C14C 15/00

[52] U.S. Cl. ..... 69/32; 68/44; 68/202

[58] Field of Search ..... 69/29, 32, 30; 68/43, 68/44, 45, 202; 8/150.5; 118/245, 248, 249

[56] References Cited

U.S. PATENT DOCUMENTS

| | | | |
|---|---|---|---|
| 3,199,317 | 8/1965 | Walsh | 68/45 |
| 3,902,338 | 9/1975 | Kessler | 69/29 |
| 4,068,620 | 1/1978 | Peters | 118/249 |
| 4,763,370 | 8/1988 | Mance et al. | 68/202 |
| 4,845,964 | 7/1989 | Bors et al. | 68/202 |

FOREIGN PATENT DOCUMENTS

| | | | |
|---|---|---|---|
| 671183 | 10/1964 | Belgium | 68/202 |
| 1486579 | 6/1967 | France . | |
| 2230728 | 12/1974 | France . | |
| 2532953 | 3/1984 | France . | |
| 1118683 | 10/1984 | U.S.S.R. | 69/29 |
| 8701401 | 3/1987 | World Int. Prop. O. | 68/202 |

*Primary Examiner*—Clifford D. Crowder
*Assistant Examiner*—Michael A. Neas
*Attorney, Agent, or Firm*—Wolf, Greenfield & Sacks

[57] ABSTRACT

A roller press for surface impregnating leather and similar materials, includes a load-bearing structure (2) which supports an upper impregnating roller (8), a lower drive roller (9), and a pair of conveyor belts (5 and 6) placed one above the other which turn in the same direction and partly touch each other so as to forward feed the leather (P) to be impregnated. The rollers are approximately parallel to each other and spaced apart so as to create a converging/diverging channel (10) between them, having the minimum section (11) approximately equal in height to the thickness of the leather being worked. There is a pressing member (20) arranged immediately upstream of the minimum section (11) which acts flexibly and uniformly over the entire width of the leather so as to keep it in stable contact with the lower drive roller (9) and preventing it from rolling up.

12 Claims, 5 Drawing Sheets

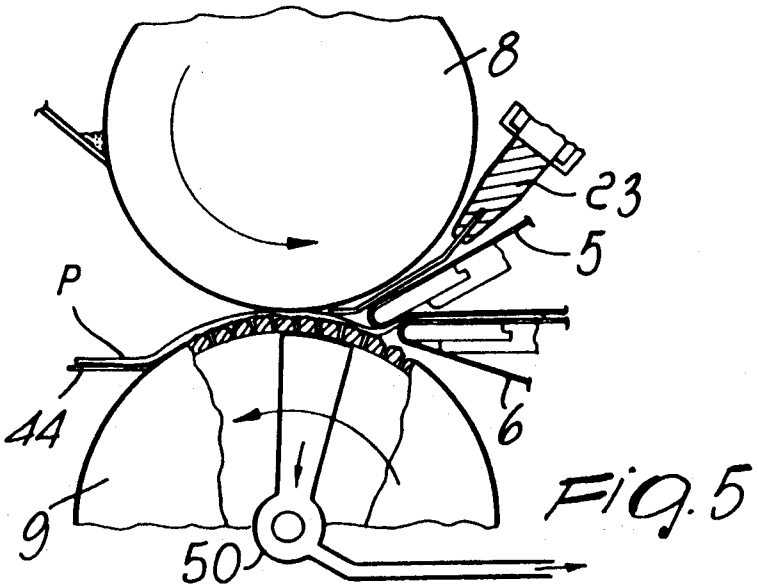
Fig. 5
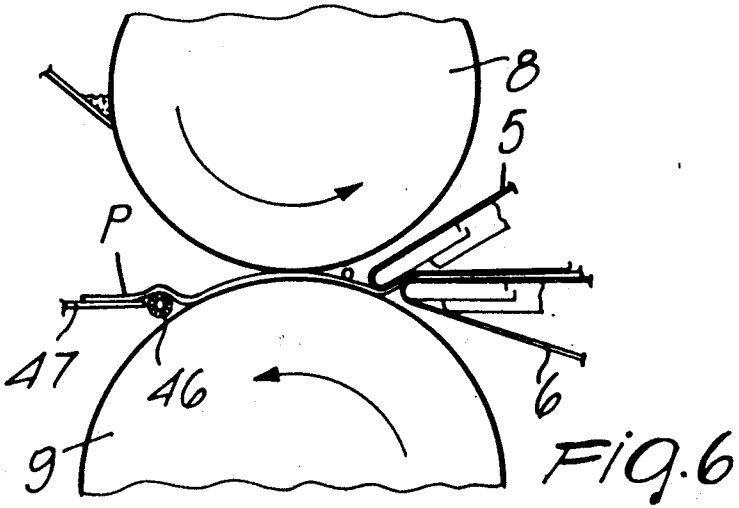
Fig. 6
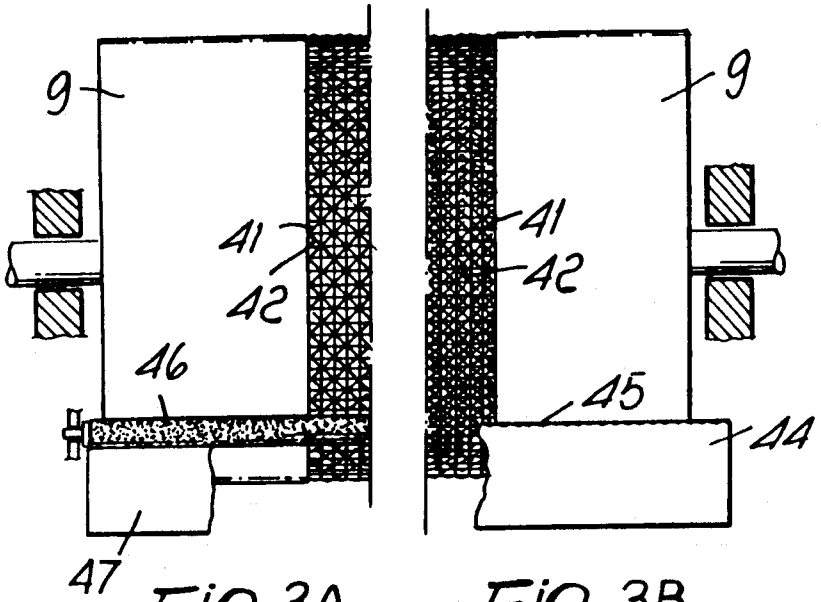
Fig. 3A
Fig. 3B
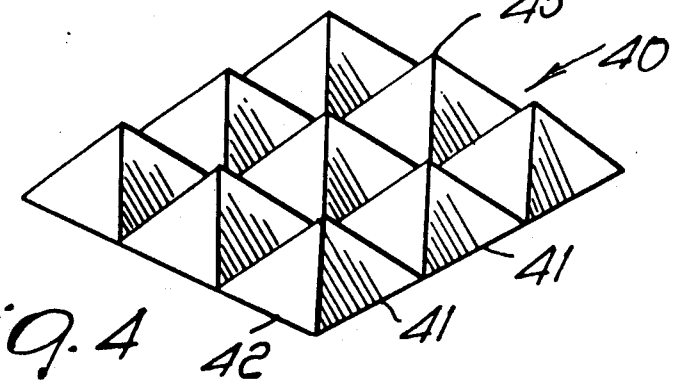
Fig. 4

ROLLER DYEING MACHINE FOR SURFACE IMPREGNATING HIDES AND SIMILAR PRODUCTS

FIELD OF THE INVENTION

The present invention relates to a roller dyeing machine for surface impregnating hides and similar products.

This type of machine is normally used to dye only one side of the hide by impregnating a thin surface layer thereof without causing the liquid dye to penetrate deep into the material. These machines can also be used to deposit a uniform layer of adhesive onto hides or similar products so that hides can be glued together.

BACKGROUND OF THE INVENTION

The known machines of this type generally include a load-bearing structure supporting a pair of motorized rollers which are placed one above the other. The upper roller deposits the dye or adhesive, the lower roller is used to feed the sheets of leather forward beneath the dye roller. Upstream of the rollers there are provided a pair of reciprocally facing conveyor belts, which rotate in the same direction, and partly contact each other to forward the hides towards the impregnation area.

The two rollers have substantially parallel axes, and are spaced slightly apart to form a converging-diverging channel with a reduced section which is slightly less than the thickness of the treated hides. The upper roller has a pad which continually impinges its surface with the impregnating liquid, this liquid being transferred to the upper surface of the hides in the restricted section of the converging-diverging channel. The lower roller is in contact with the hides over a set contact range so it transmits to the hides tangential forces which are sufficient to overcome the resistance of the upper roller while liquid is being deposited. Both rollers are connected with an electric motor by means of drive belts or similar devices, and can respectively rotate in the same direction or in opposite directions.

In the first case, the impregnating roller which contacts and slightly compresses the upper surface of the hides exerts tangential forces on the hides favoring movement thereof while the liquid is being deposited, however it does not ensure that the liquid is deposited in a perfectly uniform fashion as it is continually repelled away at the reduced section of the channel.

In the second case, on the contrary, the liquid is somewhat "spread" over the contact area, and is evenly distributed over the entire surface of the hides yielding high quality results. However, the tangential forces exerted by the upper roller on the hides act in an opposite direction with respect to the driving forces of the lower roller, and can cause a local lifting which appears as a wrinkle, in the area immediately upstream of the reduced section, where the leather is not adequately supported. This "wrinkle" can progressively degenerate and increase forming an actual roll of material, commonly termed "cigarette". It is apparent that such an accumulation of material may cause the hides to be incompletely impregnated and, in some cases, it may cause irreparable damages if the machine is not immediately stopped.

This kind of drawback mainly occurs when very soft thin leather is treated because of its inability to counter the tangential force created by the impregnating roller.

Various expedients have been adopted in known machines in order to solve the preceding problem, such as the forward offset of the upper roller with respect to the lower roller so as to create a converging-diverging channel which is slightly sloped down so that forwarding of the leather is favoured by gravity. Another solution known in the art consists of placing the tensioning roller of a conveyor belt which follows the impregnating rollers as close as possible to the reduced section of the converging/diverging channel, so as to reduce as much as possible the length of the leather which is not guided.

There is also another configuration employing a conveyor belt where the belt travels through the converging channel created by the rollers and extends both before and after them, so as to considerably increase the drive surface in contact with the leather.

Another solution consists of covering the drive roller with a uniform layer of rubber, or a similar elastomer, so that the friction coefficient is increased and drive improved.

Although these expedients can reduce the risk of wrinkling of the hides which are more than 1 mm thick, they are no longer effective for hides with lower thickness, and thus, after the machine has been operating for a certain time, they are unable to prevent the hides from rolling and forming a "cigarette". It is consequently necessary to stop the machine, separate the rollers, and stretch the hides before the machine can be started again; this involves considerable waste of labor time, low productivity, and continual attendance of control personnel.

SUMMARY OF THE INVENTION

The main aim of the present invention is to obviate the above mentioned problems by providing a reliable roller dyeing machine which operates in such a way as to ensure optimum impregnation conditions of the hide without causing it to form rolls while being impregnated.

Within this main aim, an object of the present invention is to create a device which enables the leather to be continually and uniformly fed between the rollers, even when the leather is less than 1 mm thick.

A further object of the invention is to provide a machine which ensures the complete integrity of the leather while the impregnating liquid is being deposited.

Still a further aim of the invention is to provide a machine which is constructively very simple so that it requires very little maintenance.

This aim, the above object, and others which will be apparent hereinafter are achieved by a roller dyeing machine for the surface impregnation of hides and similar products, in accordance with the attached claim 1.

BRIEF DESCRIPTION OF THE DRAWINGS

Further characteristics and advantages of the invention will be apparent by the description of some preferred, but not exclusive, embodiments according to the invention, which are shown in the indicative and not limiting drawings attached, in which:

FIGS. 3A and 3B are schematic plan views of partially sectioned details of FIG. 1 taken along line 3—3.

FIG. 4 is an enlarged perspective view of the surface of the lower roller in FIG. 3, enclosed by the circle IV of FIG. 1;

FIG. 5 shows a detail of FIG. 1 in a first embodiment;

FIG. 6 shows a detail of FIG. 1 in a second embodiment;

DETAILED DESCRIPTION

Figure 1:
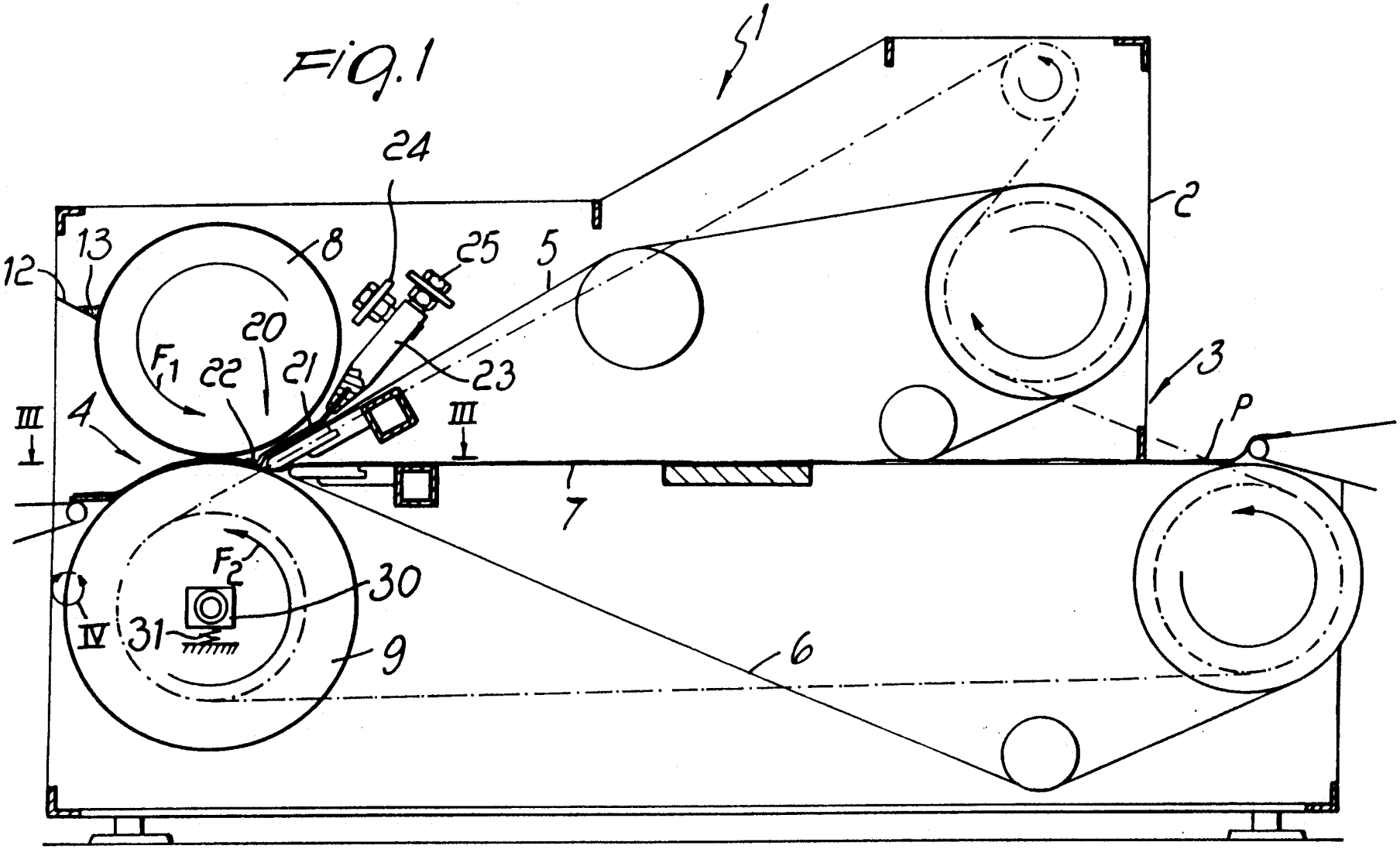
FIG. 1 is a schematic side view of a roller press according to the invention, partly sectioned along a vertical plane.

With reference to the above figures, the roller dyeing machine according to the invention, generally designated by the reference number 1, substantially comprises a load-bearing structure 2 which supports the moving parts of the machine and which defines an inlet section 3 for the hides to be treated and an outlet section 4 for the hides already treated.

At the inlet section 3 there are two conveyor belts 5, 6 which move in the same direction and partially touch each other along a central linear section 7 so as to hold and move the hides P while keeping them substantially extended and flat. A pair of superimposed rollers 8, 9 is arranged downstream of the two conveyor belts 5, 6; the upper roller 8 is adapted to dye the hide P, while the lower roller 9 is adapted to drive it forward during impregnation.

The rollers 8, 9 are substantially parallel and slightly spaced from each other so that a converging/diverging channel 10 is formed between their adjacent surfaces, with a narrow section 11 whose height d is equal to, or less than, the average thickness s of the hides. Thus, the hides fed by the belts 5, 6 are deposited on the drive roller 9 and advanced into the converging section of the channel 10 until they reach the section 11, the upper surface thereof is impinged by the impregnating roller 8.

The roller 8 is conveniently provided with a hopper, or pad, 12, adapted to contain the dye or adhesive 13 which is transferred to the surface of the roller and thereafter to the upper surface of the hides.

In the embodiment shown in the drawings, arrows F1 and F2 show the directions of rotation of the rollers 8, 9, which are counterclockwise for both rollers, so that the tangential speed of the two rollers is opposed in the reduced section. Thus, the hides P are impregnated counter-directionally by the impregnating roller 8 which will generate on the upper surface of the hides, and at the section 11, tangential forces which are opposite to the friction force generated between the lower surface of the hides and the drive roller 9.

Expediently, according to the invention, a pressing device, generally indicated by the reference number 20, is arranged between the end section of the conveyor belts 5, 6 and the reduced section 11 of the converging-/diverging channel 10, immediately upstream of the channel.

In particular, this pressing device can be formed by a fixed blade 21 which extends transversely to the advancement direction of the hides. The blade 21 is provided with a front edge 22, shaped as a sort of spatula, which is inserted into the converging section of the channel 10 and touches the upper surface of the leather P pressing the leather against the drive roller 9. As a consequence of such compression, the friction force generated between the leather P and the drive roller 9 will be proportionally increased, ensuring the forward motion of the hides under all conditions. To this end, during operation, the minimum distance m between the front edge 22 of the blade 21 and the drive roller 9 is kept at less than the thickness s of the leather P.

In order to achieve such conditions with hides of different thicknesses, the blade 21 is connected to the supporting structure 2 through a support plate 23 with bolts or similar adjustable parts 24, 25 so that the position of the blade can be both vertically and horizontally adjusted. Thus, the front edge 22 of the blade 21 can be moved both closer to the drive roller 9 and to the minimum height section so that the way the leather adheres to the drive roller 9 can be regulated as desired.

Advantageously the minimum distance n between the front edge 22 and the impregnating roller 8 has a value slightly less than the thickness of the treated hides P so as to avoid back flowing of the hides along the converging part of the channel 10. Furthermore, the drive roller 9 turns on supports 30 having a certain resiliency in a vertical direction against the reaction of elastic means 31, whose elasticity can be adjusted to allow the drive roller 9 to move downwardly when material accumulates up to a predetermined thickness between the edge 22 of the pressing blade 21 and the minimum height section 11 of the channel.

Figure 7:
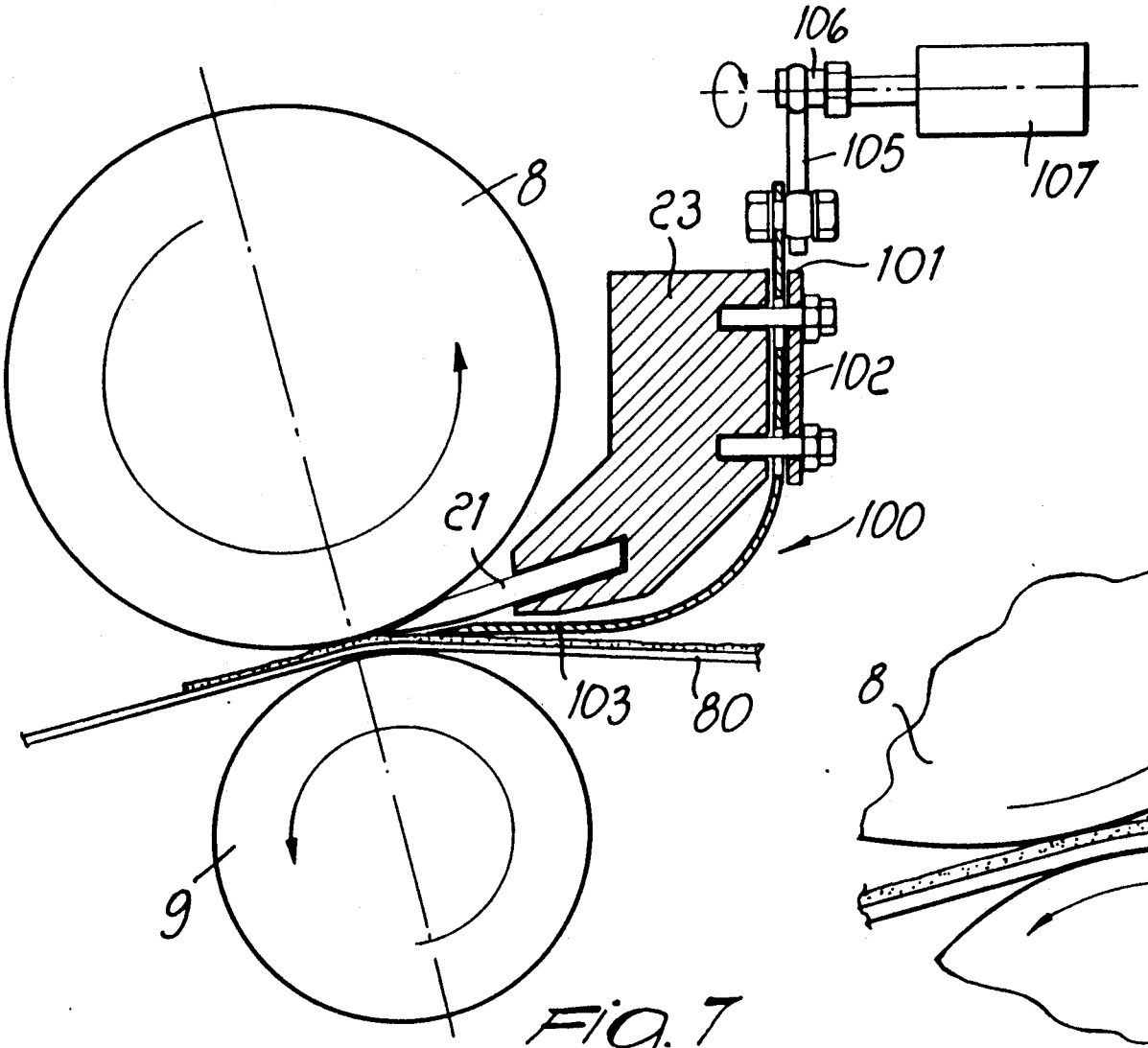
FIG. 7 shows a detail of FIG. 1 in a third embodiment.
Figure 8:
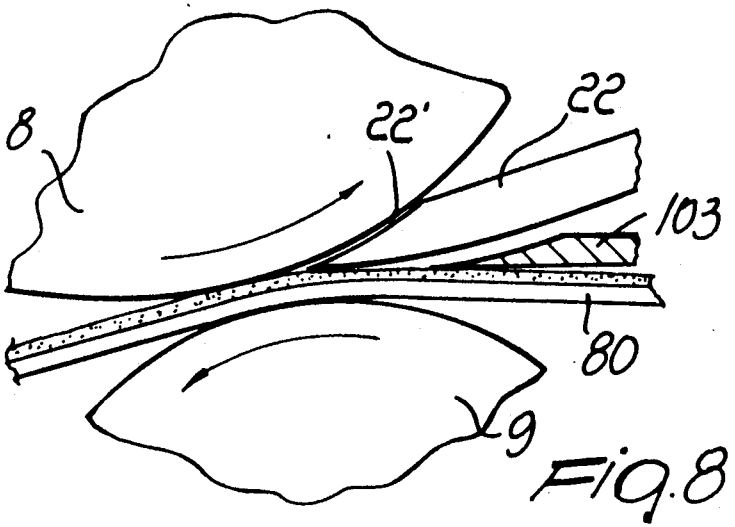
FIG. 8 is a detail of FIG. 7 in enlarged scale.

In the embodiment shown in FIGS. 7 and 8, the pressing device comprises, in addition to the fixed blade 21, a hitting blade 100 having an end portion 101 arranged just upstream of the end portion of the fixed blade 21. Advantageously, the hitting blade 100 comprises a substantially vertical upper portion 101 and a substantially horizontal lower portion 103. The upper portion 101 is slidably housed in a guiding lug 102 made of antifriction material so as to freely oscillate in a vertical direction. The lower portion 103 of blade 100 is spatule shaped so as to be arranged between the free end of the fixed blade 21 and the drive roller 9, possibly with overlaying a conveyor belt 80.

The blade 100 is coupled to a reciprocating actuating means consisting, for example, of a rod 105 connected with a crank 106 drivingly coupled to a gear motor 107.

Adjusting means of per se known type are provided to adjust the stroke as well as the oscillating frequence of blade 100. Such frequence may range between, for example, 100 Hz and 2000 Hz depending on the type of skins under treatment.

Of course, in lieu of the rod-and-crank arrangement, any different reciprocating actuating means of pneumatic, electric or mixed type may be employed without departing from the scope of the invention.

In order to minimize the interspace v between the impregnating roller and the end portion of the fixed blade 21, this latter may be provided on the upper region thereof with a slightly curved profile 22' so as to follow the adjacent profile of the impregnating roller 8. More particularly, the curvature of the profile 22' will be the same as that of the roller 8, and the value of the interspace v may be slightly less than the thickness of the hides to thereby prevent them from backward moving therethrough owing to the tangential force exerted by the impregnating roller 8 in the opposite sense of the forward feeding advancement.

In order to increase adherence between the leather and the drive roller 9, the external cylindrical surface of the roller can have a number of substantially pointed projections which can penetrate the lower surface of the hides P.

Advantageously, the projections can include pyramid shaped formations 40 with a square base which define side faces 41, 42 and edges 43. The side faces 41, 42 can be respectively parallel and perpendicular to the advancement direction of the hides, as shown in FIG. 3*b*, or at an angle between 0° and 45°, as shown in FIG. 3*a*. Two different types of device for detaching the hides from the drive roller 9 are shown in these Figures, including a comb 44 with a serrated edge 45, or a rotating brush 46, which are followed by a guide surface 47 or similar means which collects the hides before they are forwarded to the next stage of production. The maximum degree of drive continuity is ensured by the fact that the edge 22 of the blade 21 slightly compresses the leather P onto the projections 40 with points 43 on the drive roller 9 causing it to adhere in a stable fashion. In order to avoid that the irregularities created by these projections 40 may have an effect on the way the leather is impregnated, the height and distance between the projections is generally between 0.5 and 3 mm, and preferably between 1 and 2 mm. The projections can be created by knurling or similarly working a cylinder made of a hard metal such as cast-iron or steel and then chrome-plating it.

A further pressing device, acting on the leather in order to improve its adherence with the drive roller 9, includes the front end of the upper conveyor belt 5 where the diameter and position of the tensioning roller 60 guides the leather to the output of the straight section 7 of the belt. The position of the end roller 60 is adjusted so that the minimum distance t between the upper belt 5 and the external surface of the drive roller 9 is slightly less than the thickness s of the leather P. Thus, the leather is forced against the surface of the drive roller 9 at the output of the conveyor belts and adheres in a uniform fashion to it.

In an alternative embodiment, the pressing device can include any device or mechanical element which extends across the leather at right-angles to its direction of travel and is placed in the converging part of the channel 10 at a distance from the drive roller 9 which is less than the thickness of the leather. One example of an alternative pressing device could include a wire member 70 shown in cross-section in FIG. 6, which is stretched at its ends by adjustable supports similar to the adjustments bolts 24, 25 on the beam 23.

Figure 2:
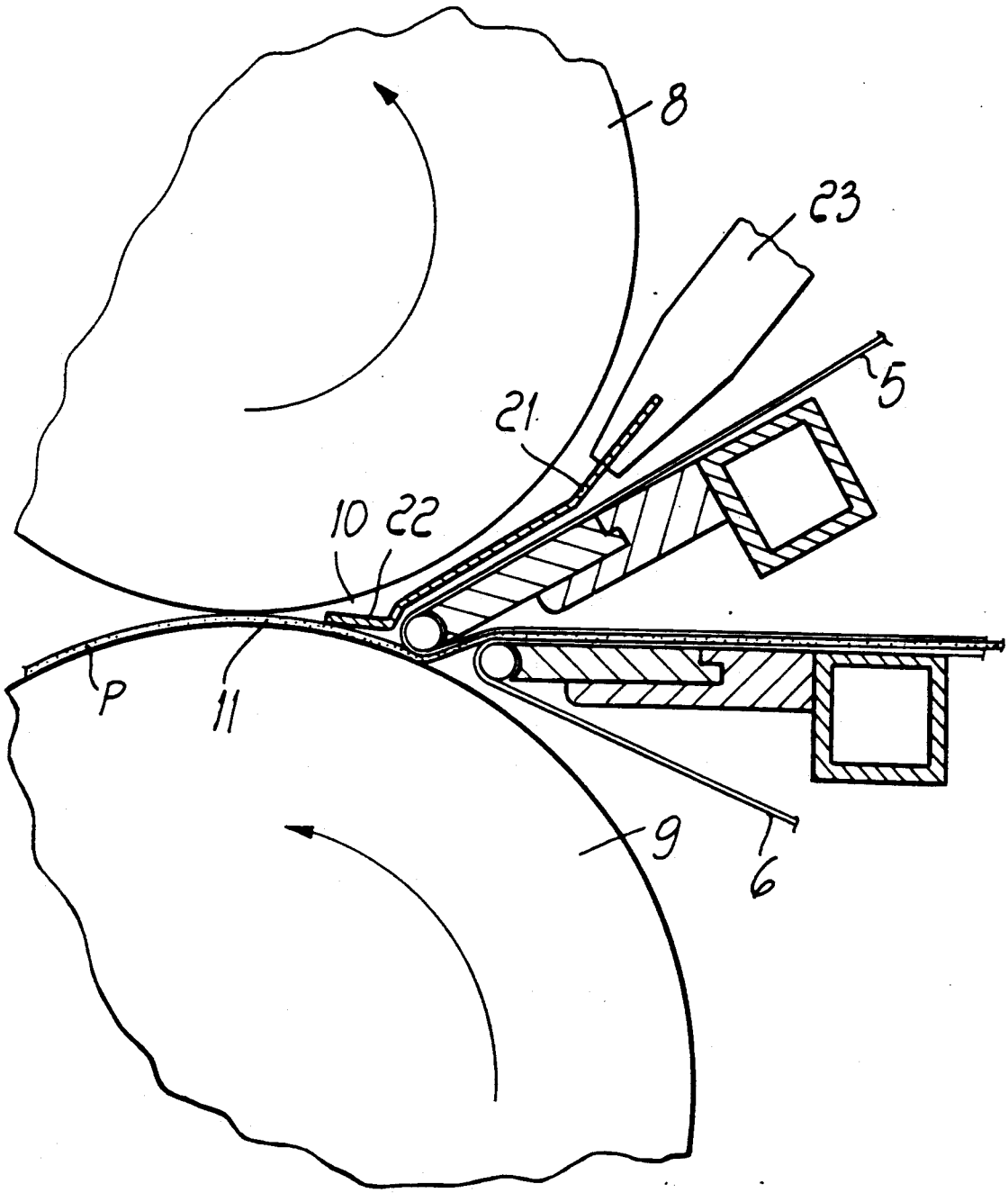
FIG. 2 is an enlarged view of a detail of FIG. 1.
Figure 2A:
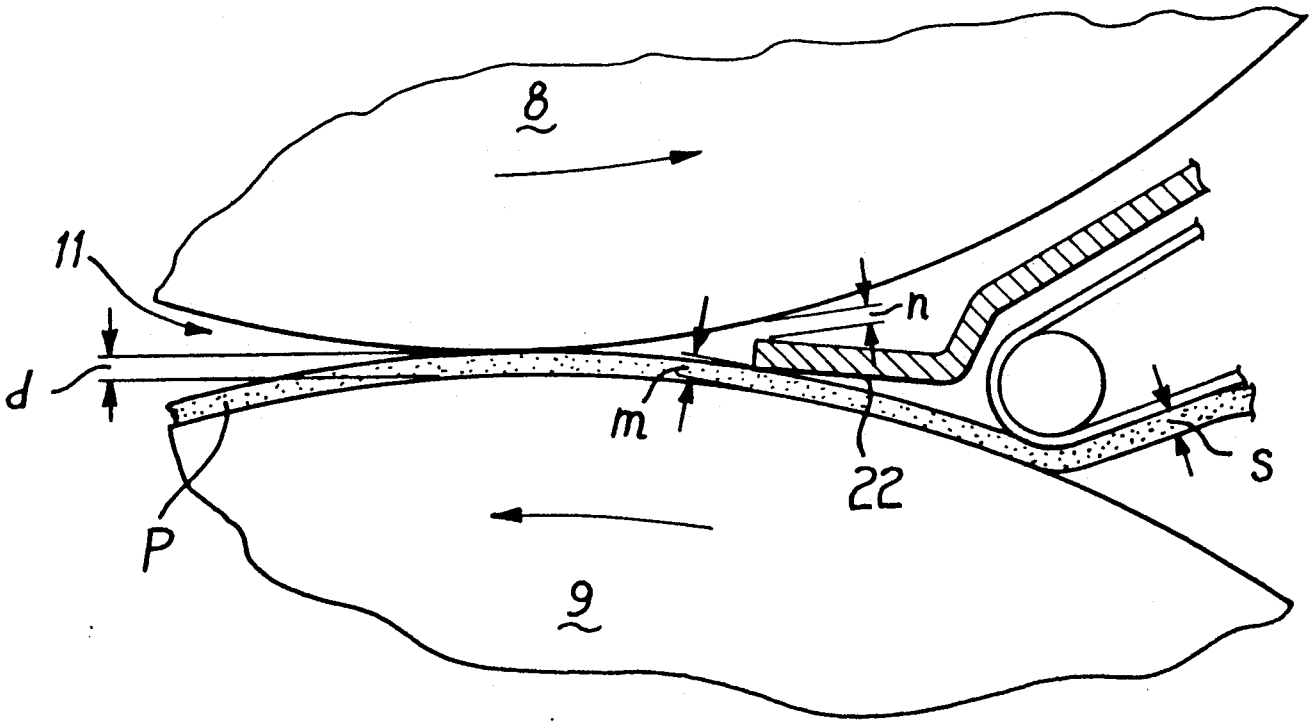
FIG. 2A is a still further enlarged view of a detail of FIG. 2.

Reference is also made herein to FIG. 2A which illustrates further detail of the construction of FIG. 2 particularly highlighting further specific dimensions referenced in this application.

The machine according to the invention operates as follows.

The leather to be impregnated P is introduced into the input section 3 between the two conveyor belts 5, 6, which then draw it along the flat section 7 and compress it against the drive roller 9 which is rotating counterclockwise. The pointed projections on the external surface of the drive cylinder 9 ensure that the leather adheres to the roller, and the leather is then drawn towards the minimum section 11 of the converging channel 10. The adherence of the leather to the surface of the drive roller 9 is increased by a pressing device 20 which is inserted in the converging channel 10 at a minimum distance from the minimum section of the channel 11. The presence of a vacuum device 50 ensures the good adherence of the leather in the area between the front edge 22 of the blade 21 and the passage section 11 of the channel. Also, the minimum distance n between the front edge 22 of the blade 21 and the surface of the impregnating roller 8 is such that the leather is prevented from back flowing and forces the drive roller 9 to lower, whose supports may be connected to a switch which cuts off power to the roller and conveyor belt drive motors, thus stopping the machine.

It has been seen in practice that a machine according to the invention has achieved the above aim, in as much as the pressing device which acts on the leather close to the area where the impregnation liquid is deposited avoids the formation of rolls during the feed between the rollers, and allows the feed to be regular and the impregnation liquid to be uniformly deposited.

Numerous modifications and variations can be made to the above described machine which all come within the scope of the invention a defined in the attached claims.

For example, in place of the hard metal drive roller 9 with pointed projections, it would be possible to use a roller with a smooth surface made of an elastomer such as rubber or a similar material.

I claim:

1. Roller machine for surface impregnating leather products with an impregnating liquid, comprising: a load-bearing structure which supports an upper impregnating roller, a lower drive roller arranged substantially parallel to the upper impregnating roller and slightly spaced apart so as to create a converging/diverging channel between them whose minimum passage section is approximately equal in height to the thickness of the leather product being worked, said upper and lower rollers being rotated in the same rotational direction so that the tangential speeds of said rollers are opposed in said minimum passage section, and at least one conveyor belt arranged at the converging side of said channel so as to forward feed the leather product to be impregnated to the minimum passage section; and a pressing device arranged immediately upstream of said minimum passage section which acts flexibly and uniformly over the entire width of the leather product so as to keep it in stable contact with said lower drive roller thereby preventing rolling up of the leather product.

2. Machine, according to claim 1, wherein said pressing device comprises a fixed blade placed across said channel with a spatula shaped edge which presses the upper surface of the leather product to be impregnated in a first region just upstream of said minimum passage section.

3. Machine, according to claim 2, wherein said blade is attached to said load-bearing structure via supports which can be both vertically and horizontally adjusted.

4. Machine, according to claim 2, wherein when in use, the horizontal and vertical position of said blade is adjusted so that the minimum distance between its edge and said lower drive roller is slightly less than the thickness of the leather product being worked.

5. Machine, according to claim 2, wherein when in use, the horizontal and vertical position of said fixed blade is adjusted so that the maximum distance between its edge and said upper impregnating roller is slightly less than the thickness of the leather product being worked, to prevent backward movement of the leather product within the interspace between the fixed blade and the impregnating roller,

6. Machine, according to claim 1, wherein it comprises an upper conveyor belt and a lower conveyer belt, each belt having an output end, said output end of the upper conveyor belt reaching further forward than that of the lower belt, and wherein the minimum distance from said lower drive roller to the output end of the upper conveyor belt is adjustable and, when in use, said distance is approximately equal to the thickness of the leather product being worked, so as to guide the leather product and stretch it uniformly over said lower drive roller.

7. Machine, according to claim 1, wherein said lower drive roller rotates about an axle which is supported at its ends by a means for support at each end, the means for support including a degree of elasticity which can be preset so that said lower drive roller moves away from the upper impregnating roller if the leather product should form a roll while being worked.

8. Machine, according to claim 2, wherein said pressing device further comprises a hitting blade adjacent to the fixed blade to alternatively flatten the leather product in a second region just upstream of the first one.

9. Machine, according to claim 8, wherein said hitting blade is slideably arranged for oscillation in a vertical direction towards and away form the lower drive roller to flatten any possible incipient winding up of the leather products.

10. Machine, according to claim 9, wherein the end portion of the fixed blade has a tapered forward free edge with an upper profile which is slightly concavely curved with a radius of curvature which is substantially the same as that of the adjacent upper impregnating roller to minimize the interspace comprised therebetween.

11. Machine, according to claim 10, wherein the machine further comprises actuating means coupled to said hitting blade to promote oscillation thereof with an adjustable frequence comprised between 100 Hz and 2000 Hz.

12. Machine, according to claim 11, wherein the machine further comprises a driving conveyor belt wound on said lower drive roller to forward feed the leather product relative to said upper impregnating roller.

* * * * *